US006367393B1

(12) United States Patent
Kasten

(10) Patent No.: US 6,367,393 B1
(45) Date of Patent: Apr. 9, 2002

(54) DRAWSTRING TABLE

(76) Inventor: Diane Kasten, 94 Litchfield Ave., Babylon, NY (US) 11702

( * ) Notice: Subject to any disclaimer, the term of this patent is extended or adjusted under 35 U.S.C. 154(b) by 0 days.

(21) Appl. No.: 09/629,987

(22) Filed: Jul. 31, 2000

(51) Int. Cl.[7] ..... A47B 13/00
(52) U.S. Cl. ..... 108/153.1; 108/67
(58) Field of Search ..... 108/67, 153.1, 108/90, 157.1, 154, 180, 186, 181, 34, 35, 38

(56) References Cited

U.S. PATENT DOCUMENTS

| | | | | | |
|---|---|---|---|---|---|
| 1,126,611 | A | * | 1/1915 | Wright | 108/67 |
| 3,704,674 | A | | 12/1972 | Johnson | |
| 3,884,159 | A | * | 5/1975 | Faria | 108/67 X |
| 4,026,219 | A | * | 5/1977 | Shupe et al. | 108/67 X |
| 4,686,910 | A | | 8/1987 | Skjerseth | |
| 4,958,577 | A | * | 9/1990 | Demaio et al. | 108/67 X |
| 5,339,748 | A | * | 8/1994 | Bilotti | 108/90 |
| 5,645,259 | A | | 7/1997 | Chen | |
| 5,765,487 | A | * | 6/1998 | Neff | 108/90 X |
| 5,884,566 | A | * | 3/1999 | Chen | 108/67 |
| 5,927,436 | A | | 7/1999 | Schultz | |
| 6,125,771 | A | * | 10/2000 | Platt et al. | 108/67 X |

* cited by examiner

*Primary Examiner*—José V. Chen
(74) *Attorney, Agent, or Firm*—Michael I. Kroll

(57) ABSTRACT

A table is provided with a collapsible tabletop that can be easily and quickly assembled and disassembled by simply tightening or loosening a drawstring and then either snapping the individual legs in or out, under the end leaves of the tabletop. The entire collapsed configuration is light, compact and easy to carry and store. The tabletop has a drawstring that is looped through two holes drilled laterally through the width of each of the individual tabletop leaves to link them together in assembly order. This allows the user to assemble them very quickly by simply pulling on both ends of the string with one hand while using the other to hold and disengage a spring loaded string locking device through which both ends of the string are threaded. This action draws the individual leaves together until all the dowels are firmly seated within their respective dowel holes. After the dowels in all four legs are snapped into their holes in the bottom of the two end leaves, the table is ready for use. This approach yields a product that is not only cost effective but also very user friendly, requiring minimal intuitive ability to use quickly and effectively.

11 Claims, 10 Drawing Sheets

DRAWSTRING TABLE

BACKGROUND OF THE INVENTION

1. Field of the Invention

The present invention relates generally to collapsible furniture and, more specifically, to collapsible tables. Typical devices of prior art in this field have generally relied on using mechanically controlled change of configurations of geometric constructions. This approach has lead to various types of mechanically controlled collapsing methods, which vary, from simple foldability to more complex forms. However, this rigid approach to collapsibility has kept costs higher and usability lower than might have been, had a less restrictive approach been utilized. The present invention, the Drawstring Table, is a good example of less restrictive thinking. It is a table with a collapsible tabletop and separate, manually connectable legs, the table using a drawstring looped through two holes drilled through each of the individual tabletop leaves to link the leaves together in assembly order. This allows the user to assemble them very quickly by simply pulling on both ends of the string with one hand while using the other to hold and disengage a spring-loaded string locking device which channels both sides of the string through it. This action draws the individual leaves together until all the dowels are firmly seated within their respective dowel holes. After the dowels in all four legs are snapped into their holes in the bottom of the two end leaves, the table is ready for use. This approach yields a product that is not only cost effective but also very user friendly, requiring minimal intuitive ability to use quickly and effectively.

2. Description of the Prior Art

There are other collapsible table devices designed for compact storage. Typical of these is U.S. Pat. No. 5,645,259 issued to Kao-San Chen on Jul. 8, 1997.

Another patent was issued to Charles J. Johnson et al. on Dec. 5, 1972 as U.S. Pat. No. 3,704,674. Yet another U.S. Pat. No. 4,686,910 was issued to Douglas N. Skjerseth on Aug. 18, 1987 and still yet another was issued on Jul. 27, 1999 to Stephan J Schutz as U.S. Pat. No. 5,927,436.

U.S. Pat. No. 5,645,259

Inventor: Kao-San Chen

Issued: Jul. 8, 1997

A foldable leg assembly includes an adjacent pair of upright rail retaining legs, an adjacent pair of upright rail positioning legs, four sliding blocks and two parallel support rails. Each of the rail retaining legs has a rail accommodation chamber for accommodating one of the support rails therein when the leg assembly is folded and stored. Each of the rail positioning legs is provided with a rail positioning seat for positioning an upper end of one of the support rails when the leg assembly is erected. The rails are retained on the rail retaining legs, in such a manner that each of the rails is pivotable between a horizontal position, where the rail is positioned on one of the rail retaining legs and one of the rail positioning legs, and an erected position, where the rail can fall into the chamber of the corresponding rail retaining leg. A tabletop bridges the rails for use.

U.S. Pat. No. 3,704,674

Inventor: Charles J. Johnson

Issued: Dec. 5, 1972

A flat topped support useable as a table and as a seat is made of lumber. A top is made of a plurality of short boards side-by-side and two spaced apart wood strips which extend across the undersides of the boards and is secured to all of them. The edges of the strips that face each other are undercut to form channels or recesses. Two or more pairs of crossed wooden legs support the top. A pivot bolt pivotally secures the legs of each pair together. Outside the legs at the top of the leg pairs a brace board connects the adjacent pairs and seat in the recesses. A locking bar is suspended from the top midway between the strips by a coiled spring and has its ends notched to provide seats for the lower edges of the brace boards. The spring is of such length that it is under tension when the notches of the bar seat on the lower edges of the brace boards. Lower brace boards may be used to hold the spacing between adjacent pairs.

U.S. Pat. No. 4,686,910

Inventor: Douglas N. Skjerseth

Issued: Aug. 18, 1987

A work table is disclosed having three end-to-end abutted sections joined by adjustable longitudinal bars for forming a rigid table from one or more of the respective sections. Four sets of adjustable bars extend longitudinally of the table and fit varying lengths of the table comprising from 1 to 3 sections of the abutted table members. The bars extend in parallel to the longitudinal length of the table, provide rigidity to the respective table sections as well as extend between the respective sections when on or more leaves are joined. Cross X-type legs are provided with a variable pivot. The variable pivots enables the crossover point of the legs to be varied so that the table may be disposed at various heights and inclinations about its longitudinal length. The legs are provided at their upper end with u-sectioned channels having locking wing nuts for keying at selected locations to the longitudinal bars. The legs at their lower end include parallel extending shoe members to impart a longitudinal rigidity as well as a side-by-side rigidity to the supported work surface of the table. The table when disassembled provides for convenient storage and shipment in a small, contained package. Provision is made for mounting of a quilting rack.

U.S. Pat. No. 5,927,436

Inventor: Stephan J. Schutz

Issued: Jul. 27, 1999

A foldable sawhorse/worktable comprising a work platform, a pair of scissor side support assemblies and a pair of cross braces horizontally extending between the scissor side support assemblies for stabilization purposes. Structures are for pivotally mounting top ends of each scissors side support assemblies to the underside of the work platform. It can be placed into a folded position with the work platform vertical to be conveniently stored and can be placed into an unfolded working position with the work platform horizontal to support various types of power tools and all kinds of construction materials.

While these collapsible tables may be suitable for the purposes for which they were designed, they would not be as suitable for the purposes of the present invention, as hereinafter described.

SUMMARY OF THE PRESENT INVENTION

A primary object of the present invention is to overcome the shortcomings of the prior art.

Another object of the present invention is to provide a collapsible table that can be very compactly stored.

Yet still another object of the present invention is to provide a collapsible table that is light and easy to carry when collapsed.

Another object of the present invention is to provide a collapsible table that can be quickly assembled and disassembled.

Still yet another object of the present invention is to provide a collapsible table that can be inexpensive to manufacture.

Yet another object of the present invention is to provide a collapsible table that is strong.

Yet still another object of the present invention is to provide a collapsible table that is rigid.

Additional objects of the present invention will appear as the description proceeds.

The present invention, the Drawstring Table, overcomes the shortcomings of prior art by providing a table with a collapsible tabletop that can be easily and quickly assembled and disassembled by simply tightening or loosening a drawstring and then either snapping the individual legs in or out of their places under the end leaves of the tabletop. The entire collapsed configuration is light, compact and easy to carry and store. The tabletop has a drawstring that is looped through two holes drilled laterally through the width of each of the individual tabletop leaves to link them together in assembly order. This allows the user to assemble them very quickly by simply pulling on both ends of the string with one hand while using the other to hold and disengage a spring loaded string locking device through which both ends of the string are threaded. This action draws the individual leaves together until all the dowels are firmly seated within their respective dowel holes. After the dowels in all four legs are snapped into their holes in the bottom of the two end leaves, the table is ready for use. This approach yields a product that is not only cost effective but also very user friendly, requiring minimal intuitive ability to use quickly and effectively.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
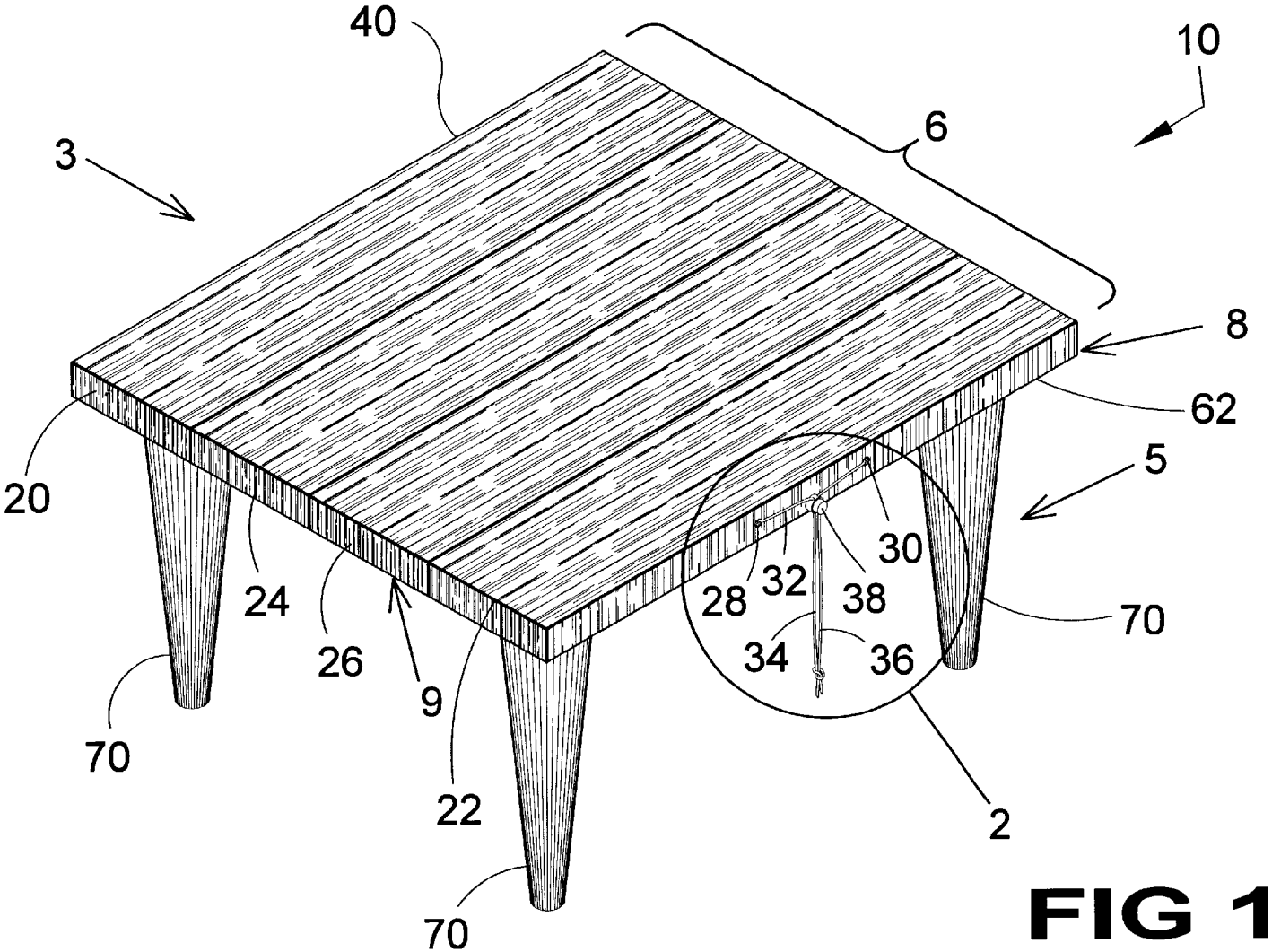
FIG. 1 is a front perspective view of the present invention, the Drawstring Table, fully assembled showing the drawstring feature.
Figure 2:
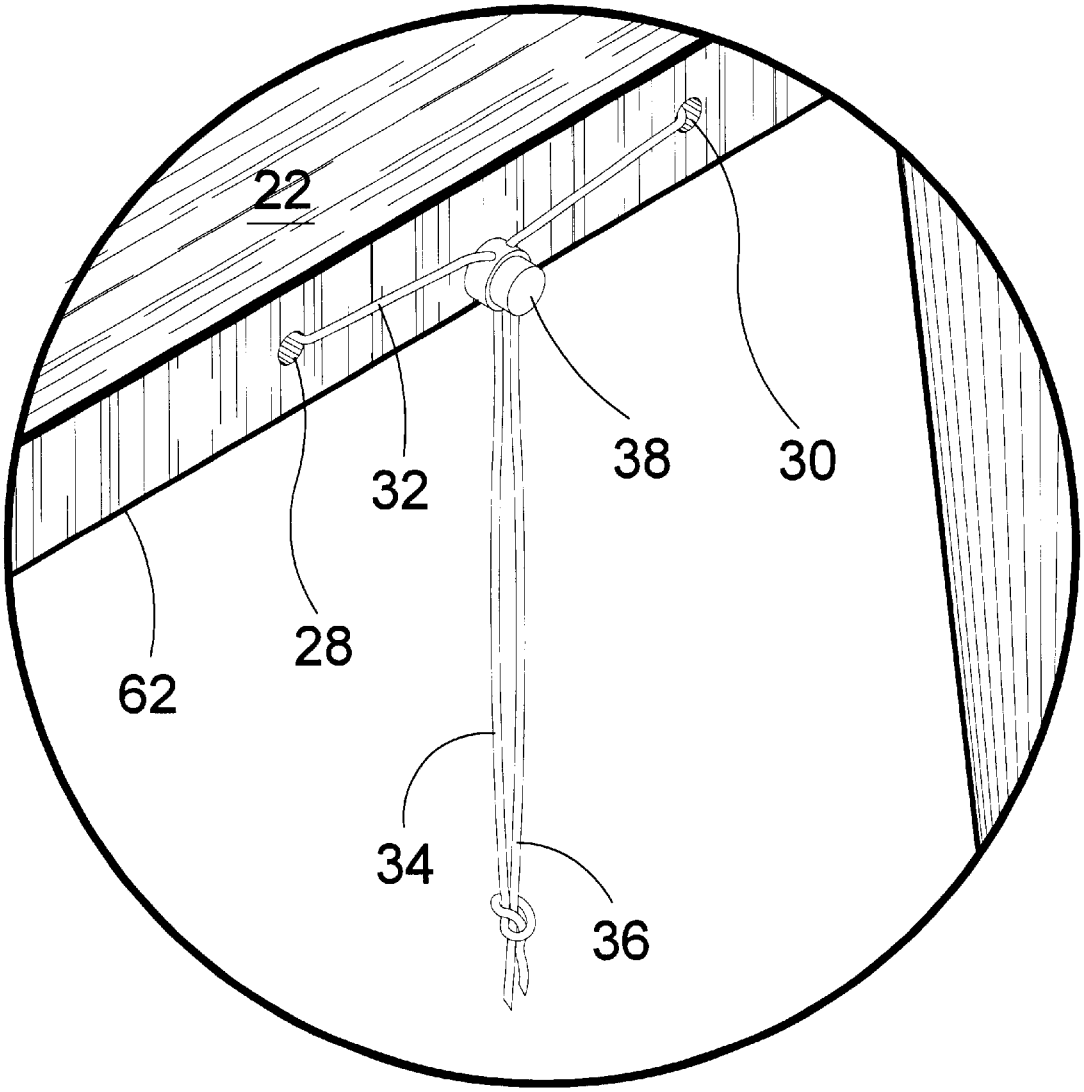
FIG. 2 is an enlarged detail perspective view of the front of the present invention showing the two ends of the drawstring feature threaded through the string locking device.
Figure 3:
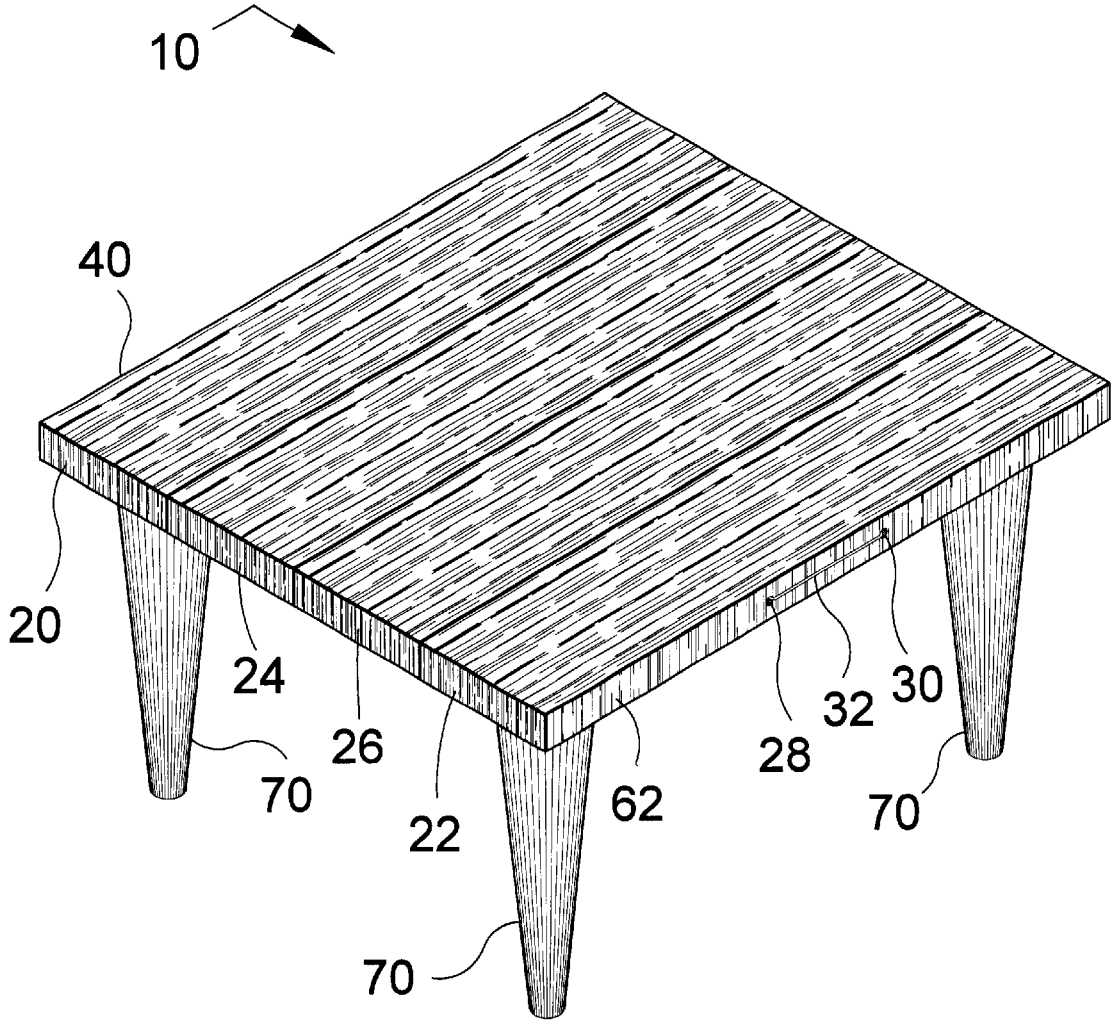
FIG. 3 is a perspective view of the back of the present invention, the Drawstring Table, fully assembled showing the looped portion of the drawstring threaded through the two holes in the end leaf of the tabletop.

Turning now descriptively to the drawings, in which similar reference characters denote similar elements throughout the several views, the Figures illustrate the drawstring table of the present invention. With regard to the reference numerals used, the following numbering is used throughout the various drawing figures.

10 drawstring table of the present invention
20 first end leaf
22 second end leaf
24 first interior leaf
26 second interior leaf
28 first holes
30 second holes
32 drawstring
34 drawstring first end
36 drawstring second end
38 drawstring lock
40 first end leaf exterior edge
42 first end leaf interior edge
44 first end leaf interior edge dowel holes
46 first interior leaf left edge
48 first interior leaf right edge
50 first interior leaf left edge dowels
52 first interior leaf right edge dowel holes
54 second interior leaf left edge
56 second interior leaf right edge
58 second interior leaf left edge dowels
60 second interior leaf right edge dowel holes
62 second end leaf exterior edge
64 second end leaf interior edge
66 second end leaf interior edge dowels
70 table legs
72 table leg dowels
74 end leaf table leg dowel holes

DETAILED DESCRIPTION OF THE PREFERRED EMBODIMENT

Turning now descriptively to the drawings, in which similar reference characters denote similar elements throughout the several views, FIGS. 1 through 10 illustrate the drawstring table of the present invention indicated generally by the numeral 10.

The device 10 is shown in FIG. 1. The device 10 in this embodiment has a first end leaf 20, a second end leaf 22, a first interior leaf 24 and a second interior leaf 26, as shown in FIGS. 1, 3, 4, and 7. Each has a first hole 28 and a second hole 30, the first holes 28 being aligned and continuous, and the second holes 30 being aligned and continuous.

Figure 4:
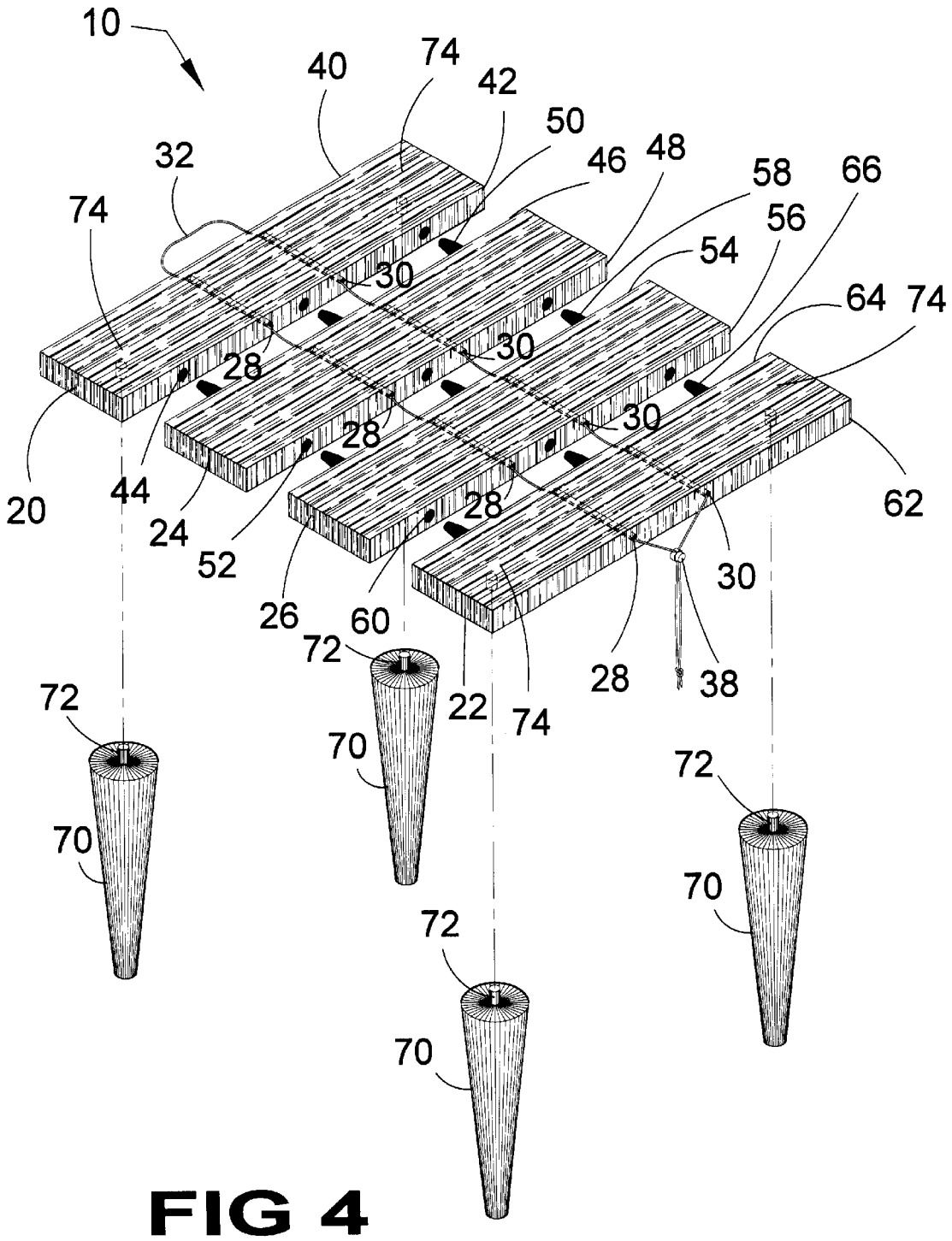
FIG. 4 is an exploded front perspective view of the present invention.
Figure 5:
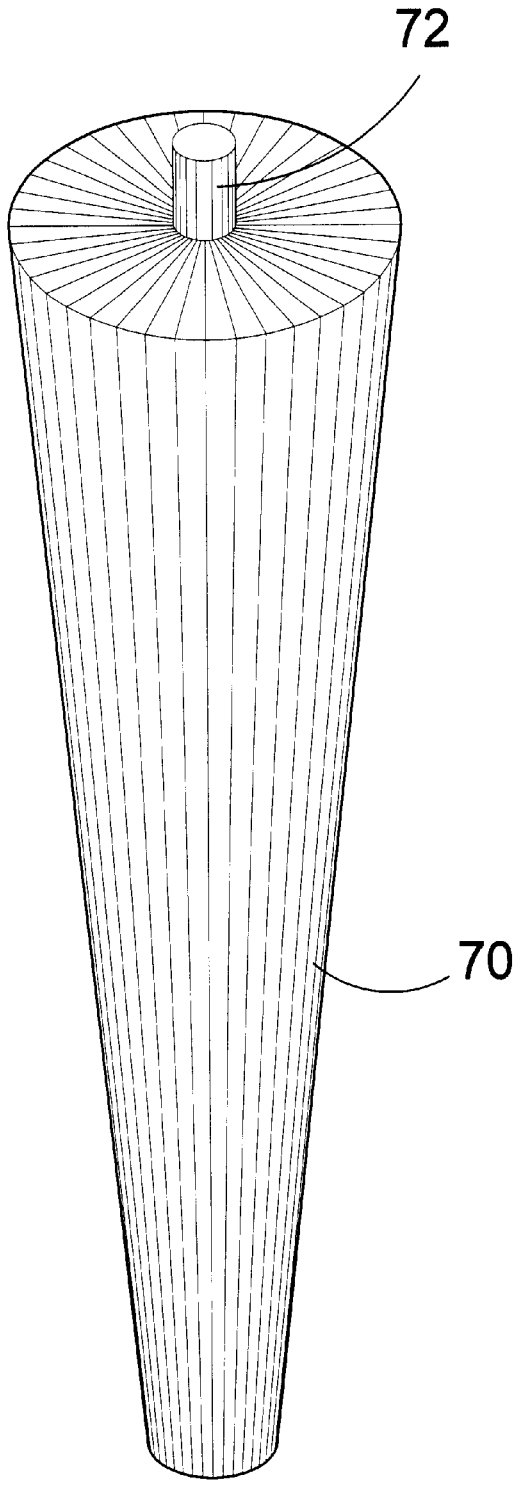
FIG. 5 is a perspective view of a typical leg with its snap in dowel.
Figure 6:
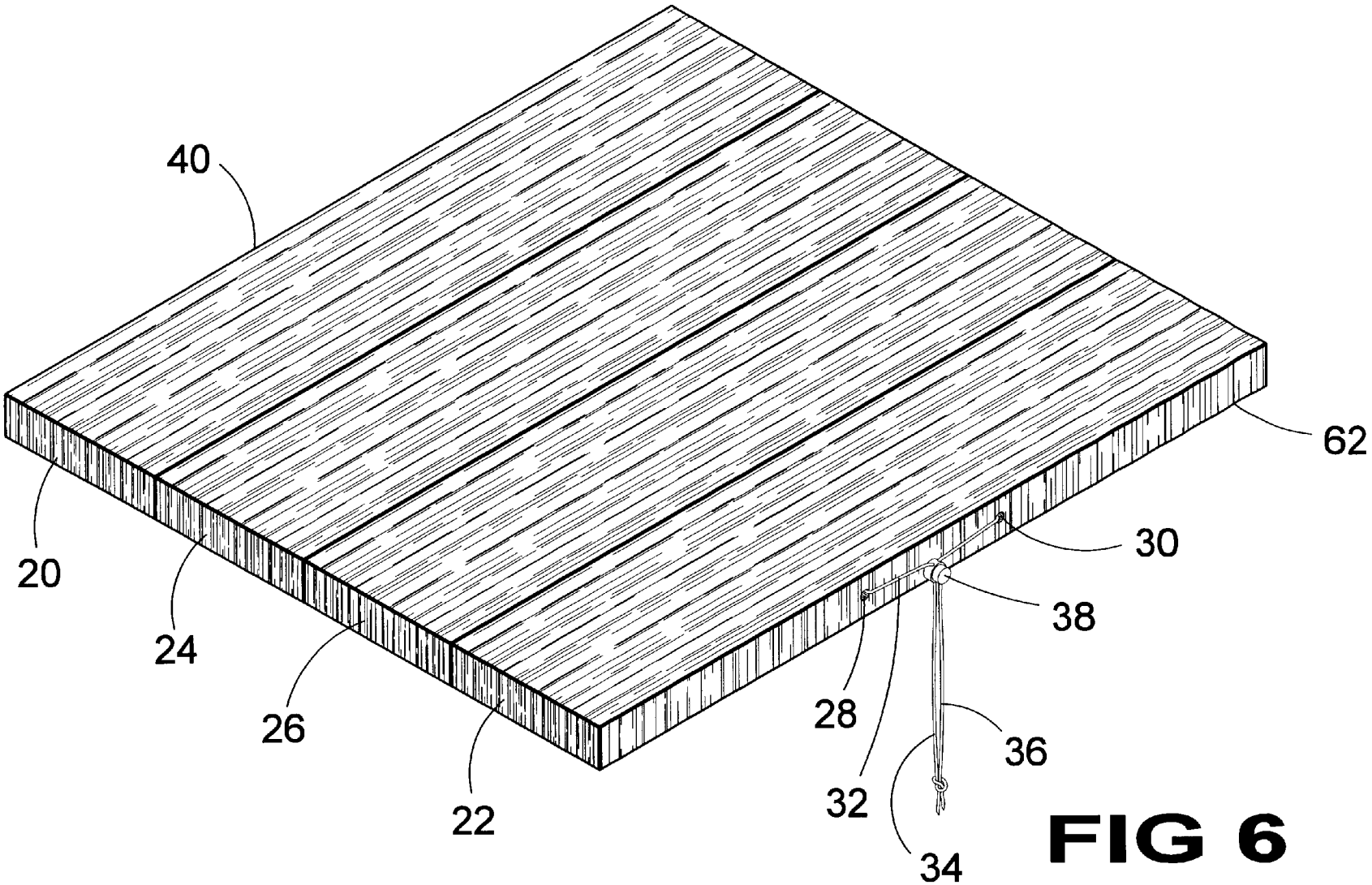
FIG. 6 is a front perspective view of the assembled tabletop of the present invention, the Drawstring Table.
Figure 7:
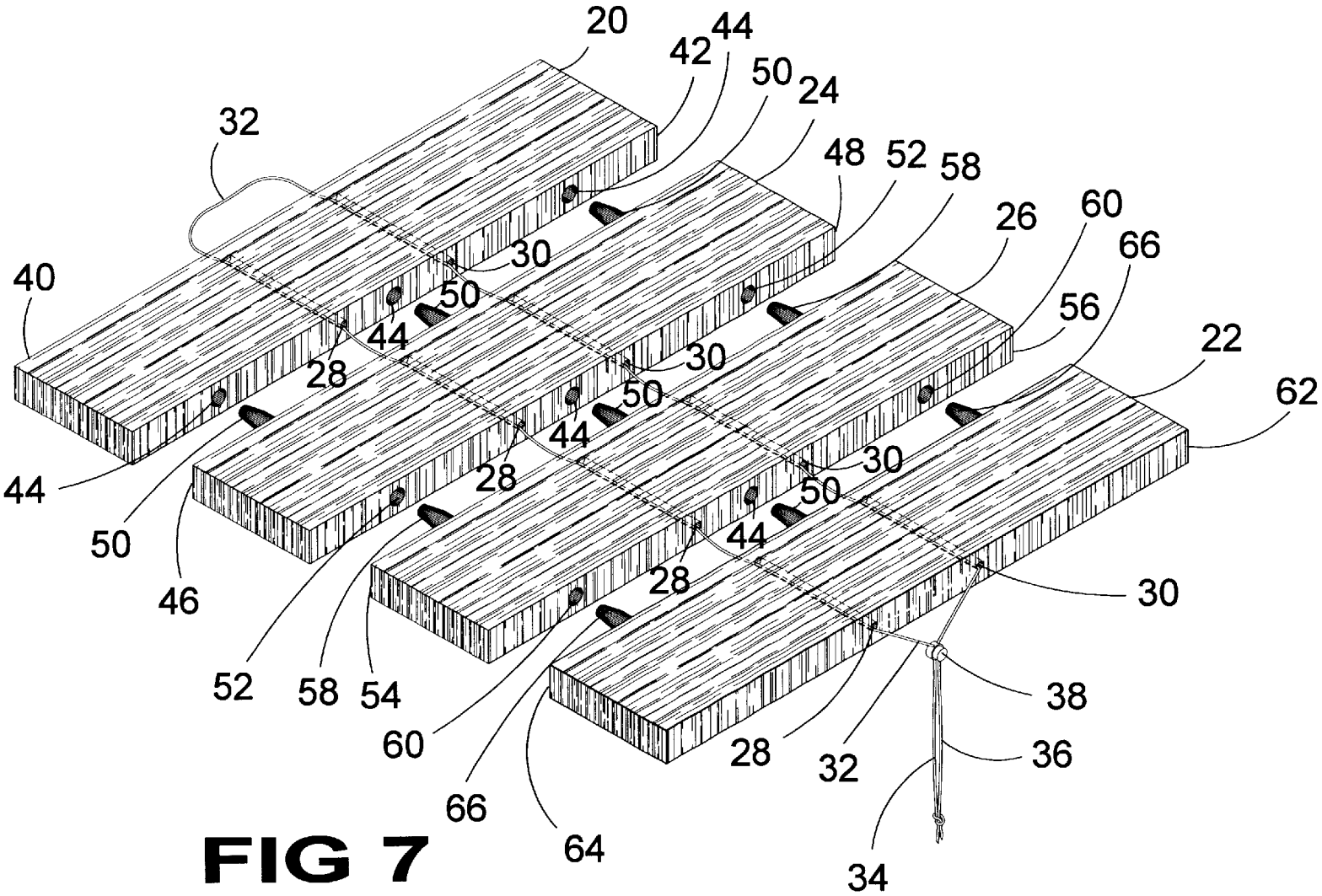
FIG. 7 is a front perspective view of the disassembled tabletop of the present invention, the Drawstring Table.
Figure 8:
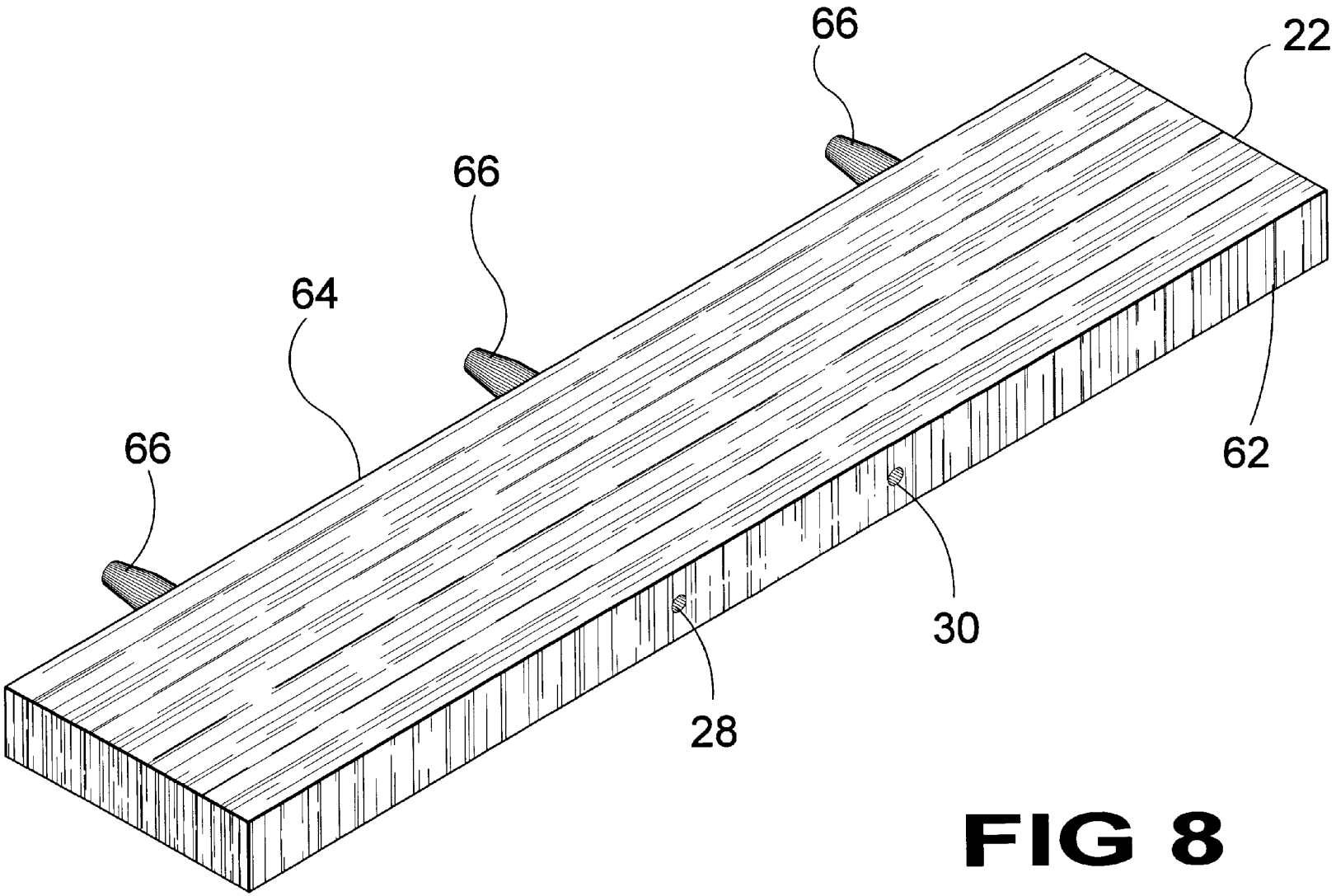
FIG. 8 is a perspective view of a table end leaf showing its three dowels and the two drawstring holes.
Figure 9:
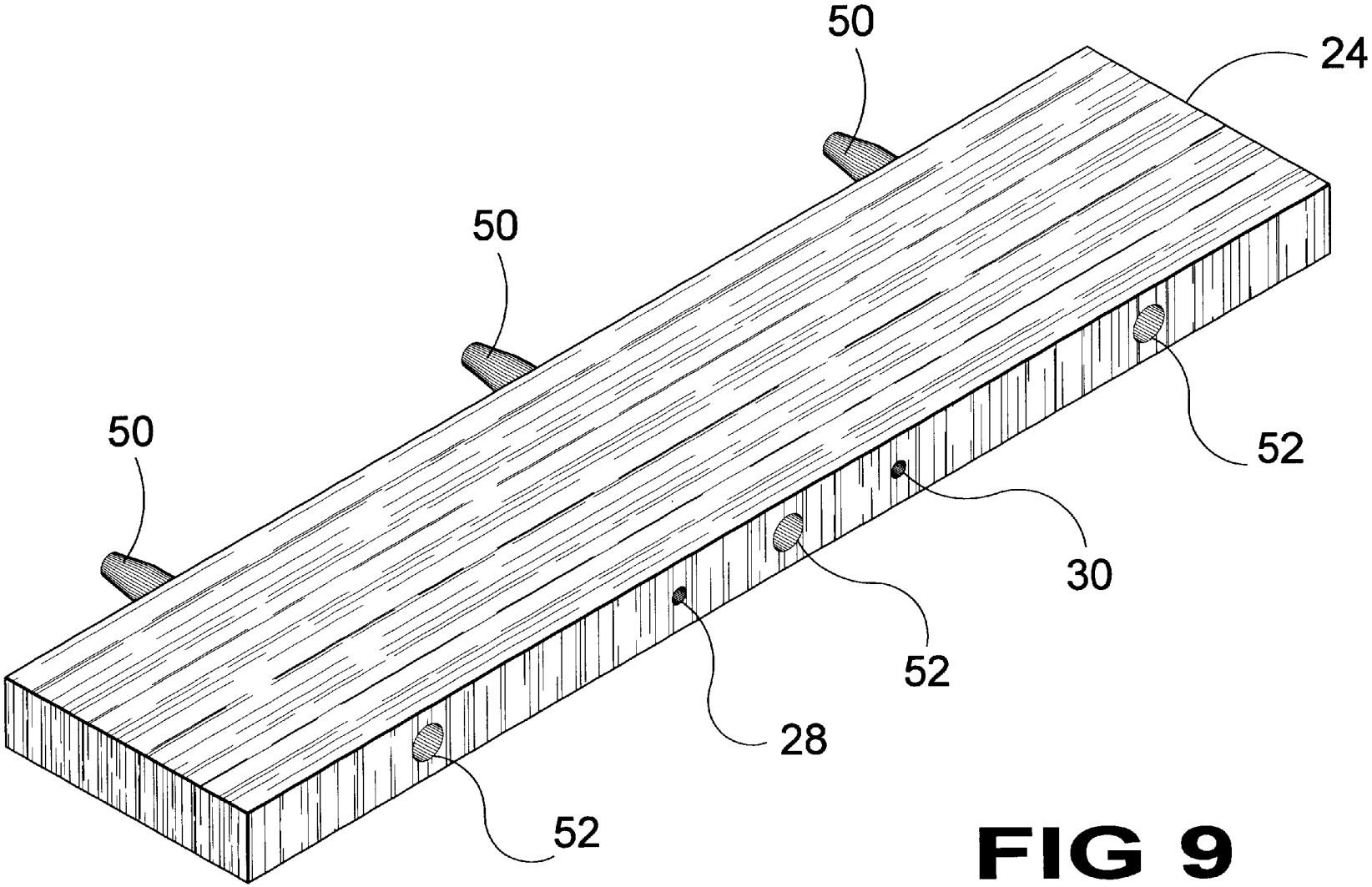
FIG. 9 is a perspective view of a table middle leaf showing its three dowels, two drawstring holes and three dowel holes for the dowels in the next leaf.

As shown in FIGS. 4 and 7, a drawstring 32 has a first end 34 and a second end 36, the drawstring first end 34 being threaded through the first holes 28, the second end 36 being threaded through the second holes 30, such that the first end 34 and second end 36 emerge from the first hole 28 and second hole 30 of the second end leaf 26. The drawstring 32 should have low tensibility, and can be made from various strings, twines and wires, all in accordance with the present invention, and as determined by the intended end use for the overall device 10, as will occur to those of skill in the art upon review of the present disclosure.

After so emerging from the second end leaf 22, the drawstring first end 34 and second end 36 are threaded through a drawstring lock 38, as shown in FIGS. 1, 2, 4, 6 and 7. The drawstring lock 38 is spring-loaded such that it allows passage of the drawstring first end 34 and second end 36 only when the drawstring lock 38 is squeezed. When squeezing ceases the drawstring lock 38 grasps the drawstring first end 34 and second end 36, preventing motion in either direction.

As shown in FIGS. 4 and 7, the first end leaf 20 has an exterior edge 40 and an interior edge 42, the interior edge 42 having three dowel holes 44. The first interior leaf 24 has a left edge 46 and a right edge 48, the left edge 46 having three dowels 50, for which the first end leaf interior edge dowel holes 44 are adapted to closely receive. These dowels 50 and dowel holes 44 are aligned when the first holes 28 and second holes 30 are aligned. The first interior leaf right edge 48 also has three dowel holes 52.

The second interior leaf 26 has a left edge 54 and a right edge 56, the left edge 54 having three dowels 58 for which the first interior leaf right edge dowel holes 52 are adapted to closely receive. These dowels 58 and dowel holes 52 are aligned when the first holes 28 and second holes 30 are aligned. The second interior leaf right edge 56 also has three dowel holes 60.

The second end leaf 22 has an exterior edge 62 and an interior edge 64, the interior edge 64 having three dowels 66 for which the second interior leaf right edge dowel holes 60 are adapted to closely receive. These dowels 66 and dowel holes 60 are aligned when the first holes 28 and second holes 30 are aligned.

When not in use, slack may be added to drawstring 32 by squeezing the drawstring lock 38 and moving the drawstring lock 38 closer to the tips of the drawstring first and second ends 34,36. With enough slack added the leaves 20,22,24,26 can be separated and compactly stacked, without removing the drawstring 32.

To assemble the device 10 for use, the leaves 20,22,24,26 are unstacked and brought together by squeezing the drawstring lock 38 and then pulling on the drawstring first and second ends 34,36. As the drawstring 32 slack is removed the first holes 28 and second holes 30 are aligned, causing the various dowels 50,58,66 to align with the various dowel holes 44,52,60. Continued tightening of the drawstring 32 presses the adjacent edges 42,46,48,54,56,64 of the leaves 20,22,24,26 together until the dowels 50,58,66 have mated with the corresponding dowel holes 44,52,60. After such mating, the tightened drawstring 32 is locked by releasing the drawstring lock 38. Dowel 50,58,66 friction and the locked drawstring 32 resist separation of the leaves 20,22, 24,26, although a properly locked drawstring 32 can prevent all or substantially all separation of the leaves 20,22,24,26 until the drawstring lock 38 is released.

Table legs 70 are detachably connected to the first end leaf 20 and second end leaf 22, by virtue of the dowel 72 on each table leg 70, and the corresponding dowel holes 74 located on the first and second end leaves 20,22, as shown in FIGS. 1, 3, 4 and 5. In other embodiments, threads (not shown) are provided for this connection.

Other embodiments also include a tongue-and-groove connection (not shown) between the leaves and a pair of drawstrings each anchored proximate the first end leaf exterior edge 40 the first being the threaded to the first holes 28, the second being threaded through the second holes 30.

Figure 10:
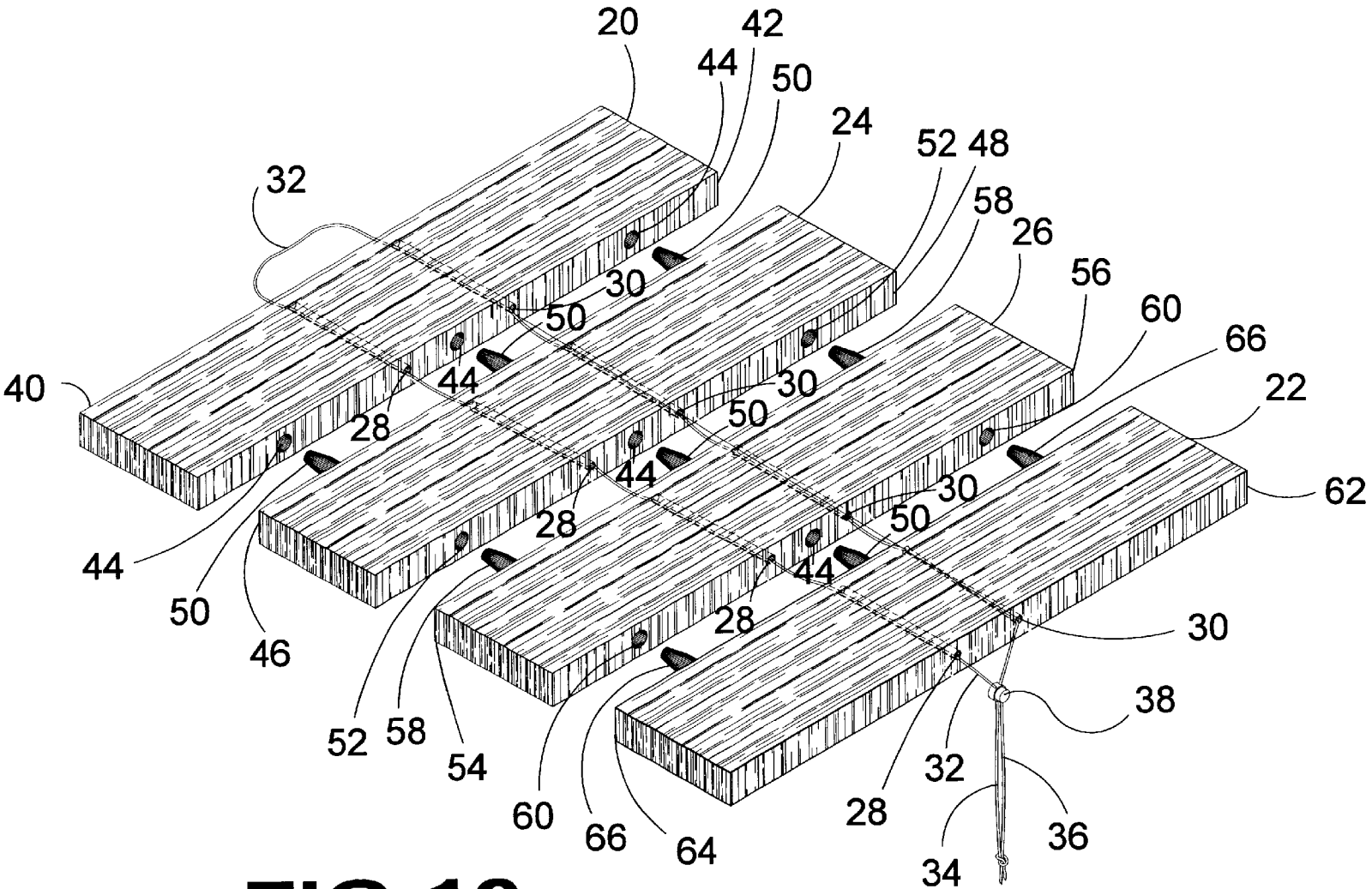
FIG. 10 is a front perspective view of the disassembled tabletop of another embodiment of the present invention, the Drawstring Table, in which the routing of the aligned drawstring holes has been changed.

In another embodiment, the tautness of the locked drawstring 32 is enhanced by angling the first holes 28 and second holes 30, such that the space between the first holes 28 and second holes 30 is less on the second end leaf exterior edge 62 than the corresponding space on the first end leaf exterior edge 40, as shown in FIG. 10.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A collapsible tabletop, comprising:

(a) a plurality of table leaves, each leaf having a first hole and a second hole, the leaf first holes being aligned from leaf to leaf, and the second holes being aligned from leaf to leaf, each leaf further having at least one edge adjacent another leaf, the adjacent edges of the leaves being compressibly joinable;

(b) a drawstring, the drawstring having a first end and a second end, the first end being threaded through the leaf first holes, the second end being threaded through the leaf second holes; and (c) a drawstring lock, the drawstring lock receiving the drawstring first end and second end such that the first and second ends may be pulled through the drawstring lock until the leaves' adjacent edges have compressibly joined in response to the tightening drawstring, the drawstring lock locking the drawstring first and second ends such that the drawstring resists separation of the leaves.

2. The device of claim 1, further comprising at least three auxiliary table legs, each leg being detachably joinable to one or more of the leaves.

3. The device of claim 2, wherein the number of table legs is four.

4. The device of claim 2, further comprising the table legs, the table legs having a top end, the table leg top end having a dowel, and the leaves, the leaves having a bottom surface, at least two of the leaves further have a hole, the number of such holes being at least three, each of the holes being adapted to receive one of the table leg top end dowels.

5. The device of claim 1, further comprising the leaves' adjacent edges, at least one of such leaves' adjacent edges having a plurality of dowels, and at least one of such leaves' adjacent edges having a plurality of holes adapted to receive such dowels.

6. The device of claim 5, wherein the number of dowels in the plurality is three.

7. A collapsible table, comprising:

(a) a plurality of table leaves, each leaf having a first hole and a second hole, the leaf first holes being aligned from leaf to leaf, and the second holes being aligned from leaf to leaf, each leaf further having at least one edge adjacent another leaf, the adjacent edges of the leaves being compressibly joinable;

(b) a drawstring, the drawstring having a first end and a second end, the first end being threaded through the leaf first holes, the second end being threaded through the leaf second holes;

(c) a drawstring lock, the drawstring lock receiving the drawstring first end and second end such that the first and second ends may be pulled through the drawstring lock until the leaves' adjacent edges have compressibly joined in response to the tightening drawstring, the drawstring lock locking the drawstring first and second ends such that the drawstring resists separation of the leaves; and (d) at least three table legs, each leg being detachably joinable to one or more of the leaves.

8. The device of claim 7, wherein the number of table legs is four.

9. The device of claim 7, further comprising the table legs, the table legs having a top end, the table leg top end having a dowel, and the leaves, the leaves having a bottom surface, at least two of the leaves further have a hole, the number of such holes being at least three, each of the holes being adapted to receive one of the table leg top end dowels.

10. A collapsible table, comprising:

(a) a plurality of table leaves;

(b) at least three table legs;

(c) means for detachably and compressibly joining the leaves such that a substantially flat surface is formed when the leaves are joined, and further such that the leaves remain connected and stackable when not joined; and (d) means for detachably joining the table legs to the leaves.

11. A collapsible tabletop, comprising:

(a) a plurality of table leaves, each leaf having a first hole and a second hole, the leaf first holes being aligned from leaf to leaf, and the second holes being aligned from leaf to leaf, each leaf further having at least one edge adjacent another leaf, the adjacent edges of the leaves being compressibly joinable;

(b) a first drawstring and a second drawstring, the first drawstring having a first end threaded through the first holes and a second end anchored to one of the table leaves, the first end being threaded through the leaf first holes, the second drawstring having a first end threaded through the leaf second holes and a second end anchored to one of the table leaves; and (c) a drawstring lock, the drawstring lock receiving the first drawstring first end and the second drawstring first end such that the ends may be pulled through the drawstring lock until the leaves' adjacent edges have compressibly joined in response to the tightening drawstring, the drawstring lock locking the first and second drawstring first ends such that the drawstring resists separation of the leaves.

* * * * *